US010062980B2

(12) United States Patent
Bugaris et al.

(10) Patent No.: US 10,062,980 B2
(45) Date of Patent: Aug. 28, 2018

(54) FIELD TERMINABLE PLUG ASSEMBLY

(71) Applicant: Panduit Corp., Tinley Park, IL (US)

(72) Inventors: Rachel M. Bugaris, Lexington, KY (US); John C. Senese, Naperville, IL (US); Derek W. Blanton, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/572,695

(22) PCT Filed: May 20, 2016

(86) PCT No.: PCT/US2016/033438
§ 371 (c)(1),
(2) Date: Nov. 8, 2017

(87) PCT Pub. No.: WO2016/191250
PCT Pub. Date: Dec. 1, 2016

(65) Prior Publication Data

US 2018/0175521 A1 Jun. 21, 2018

Related U.S. Application Data

(60) Provisional application No. 62/165,564, filed on May 22, 2015.

(51) Int. Cl.

| | |
|---|---|
| ***H01R 11/26*** | (2006.01) |
| ***H01R 4/70*** | (2006.01) |
| ***H01R 4/30*** | (2006.01) |
| ***H01R 11/32*** | (2006.01) |

(52) U.S. Cl.
CPC ..... *H01R 11/26* (2013.01); *H01R 4/30* (2013.01); *H01R 4/70* (2013.01); *H01R 11/32* (2013.01)

(58) Field of Classification Search
CPC ..... H01R 11/287; H01R 11/26
See application file for complete search history.

(56) References Cited

U.S. PATENT DOCUMENTS

| | | | | |
|---|---|---|---|---|
| 970,087 | A * | 9/1910 | Murray | H01R 4/363 403/191 |
| 2,083,923 | A | 6/1937 | Rowe | |
| 2,173,206 | A | 9/1939 | Landmeier | |
| 2,232,857 | A | 2/1941 | Jackson | |

(Continued)

FOREIGN PATENT DOCUMENTS

FR 2743947 A1 7/1997

*Primary Examiner* — James Harvey
(74) *Attorney, Agent, or Firm* — Christopher S. Clancy; James H. Williams; Christopher K. Marlow

(57) ABSTRACT

A safety termination apparatus for connecting to a power conductor has first and second galvanic connections, a sensor wire, and an insulating housing. The first and second galvanic connections are connected to an uninsulated portion of the power conductor and a sensor wire is electrically connected to each galvanic connection. The insulating housing encloses the galvanic connections and has first and second compartments for enclosing the first and second galvanic connections. The first and second compartments separate the first and second galvanic connections such that the first and second galvanic connections are not electrically connected to each other than through a mutual connection to the power conductor.

6 Claims, 6 Drawing Sheets

(56) References Cited

U.S. PATENT DOCUMENTS

| | | | | | |
|---|---|---|---|---|---|
| 2,287,761 | A * | 6/1942 | Matthysse | H01R 4/625 | 403/191 |
| 2,313,927 | A | 3/1943 | Dorfman | | |
| 2,732,535 | A | 1/1956 | Hammerly | | |
| 2,811,704 | A | 10/1957 | Newman | | |
| 2,888,565 | A | 5/1959 | Brobeck | | |
| 3,727,171 | A | 4/1973 | Coles et al. | | |
| 4,324,949 | A * | 4/1982 | Grandjean | H01R 11/05 | 174/71 R |
| 5,727,314 | A | 3/1998 | Ashcraft | | |
| 6,017,241 | A * | 1/2000 | Komai | H01R 4/2404 | 439/409 |
| 6,383,013 | B1 * | 5/2002 | Ghesla | G01D 11/24 | 439/408 |
| 7,210,957 | B2 * | 5/2007 | Mrakovich | F21V 21/002 | 439/404 |
| 9,231,314 | B2 * | 1/2016 | Peterson | H01R 4/24 | |
| 9,531,145 | B2 * | 12/2016 | Byrne | H01R 25/006 | |
| 9,640,904 | B2 * | 5/2017 | Weinmann | G01R 15/142 | |
| 9,679,235 | B2 * | 6/2017 | Sugar | G06K 19/0716 | |
| 2013/0312994 | A1 | 11/2013 | Keuss | | |
| 2014/0287622 | A1 | 9/2014 | Kinoshita et al. | | |
| 2014/0335746 | A1 | 11/2014 | Conrardy et al. | | |

* cited by examiner

FIELD TERMINABLE PLUG ASSEMBLY

FIELD OF THE INVENTION

The present invention relates generally to terminations to power conductors and more specifically to a safety termination to a power conductor for a voltage detector.

BACKGROUND OF THE INVENTION

The internet of things (IoT) movement, along with industry desire for increased safety, better energy efficiency, improved reliability, and predictive maintenance has led to an increase in discussion of industrial applications for sensing and monitoring devices. For some applications, it is often desirable to monitor electrical signals and conditions such as current or voltage. In these cases, it is necessary to be able to attach a sensing lead wire to a power conductor. The sensing lead is usually required to be connected in such a manner that allows the sensing lead to make galvanic contact with the conductor. Although the sensor lead is often connected to a conductor in the main power circuit, the sensor wire itself and the corresponding connection is not load-carrying.

For some applications, a single point of galvanic contact is sufficient. However, in some cases, it is desirable to have two leads galvanically connected to each phase of the conductor. The two leads are acting as a mechanism to a) test the device and b) verify that it is connected to a power source. In essence, the embodiment achieves the desired functionality by using the power conductor to complete the circuit. In order to achieve this desired functionality, the two sending leads must also be electrically isolated from each other. This presents several additional challenges with the connection methods established in prior art.

SUMMARY OF THE INVENTION

A safety termination apparatus for connecting to a power conductor has first and second galvanic connections, a sensor wire, and an insulating housing. The first and second galvanic connections are connected to an uninsulated portion of the power conductor and a sensor wire is electrically connected to each galvanic connection. The insulating housing encloses the galvanic connections and has first and second compartments for enclosing the first and second galvanic connections. The first and second compartments separate the first and second galvanic connections such that the first and second galvanic connections are not electrically connected to each other than through a mutual connection to the power conductor.

DETAILED DESCRIPTION OF THE PREFERRED EMBODIMENTS

The new termination method consists of a method to tap two sensor leads onto a power conductor while keeping the leads isolated from each other (other than through a mutual connection to the power conductor) and without cutting, splicing, or damaging the power conductor.

The method consists of assembling several parts and is designed to slip on over one end of a power conductor where the cable insulation (jacket material) has been stripped away to provide a method by which to galvanically couple a sensing lead wire to a power conductor for the purpose of carrying an electronic signal between the sensing device and power conductor. It is not intended to be used as a load carrying power connection. A single connector can be designed to accept a variety of wire gauges (e.g., 14AWG-2AWG) and a family of connectors can be designed to accommodate various AWG, metric wire sizes (for example standard wire gages ranging from 14AWG through 1000MCM).

Figure 1:
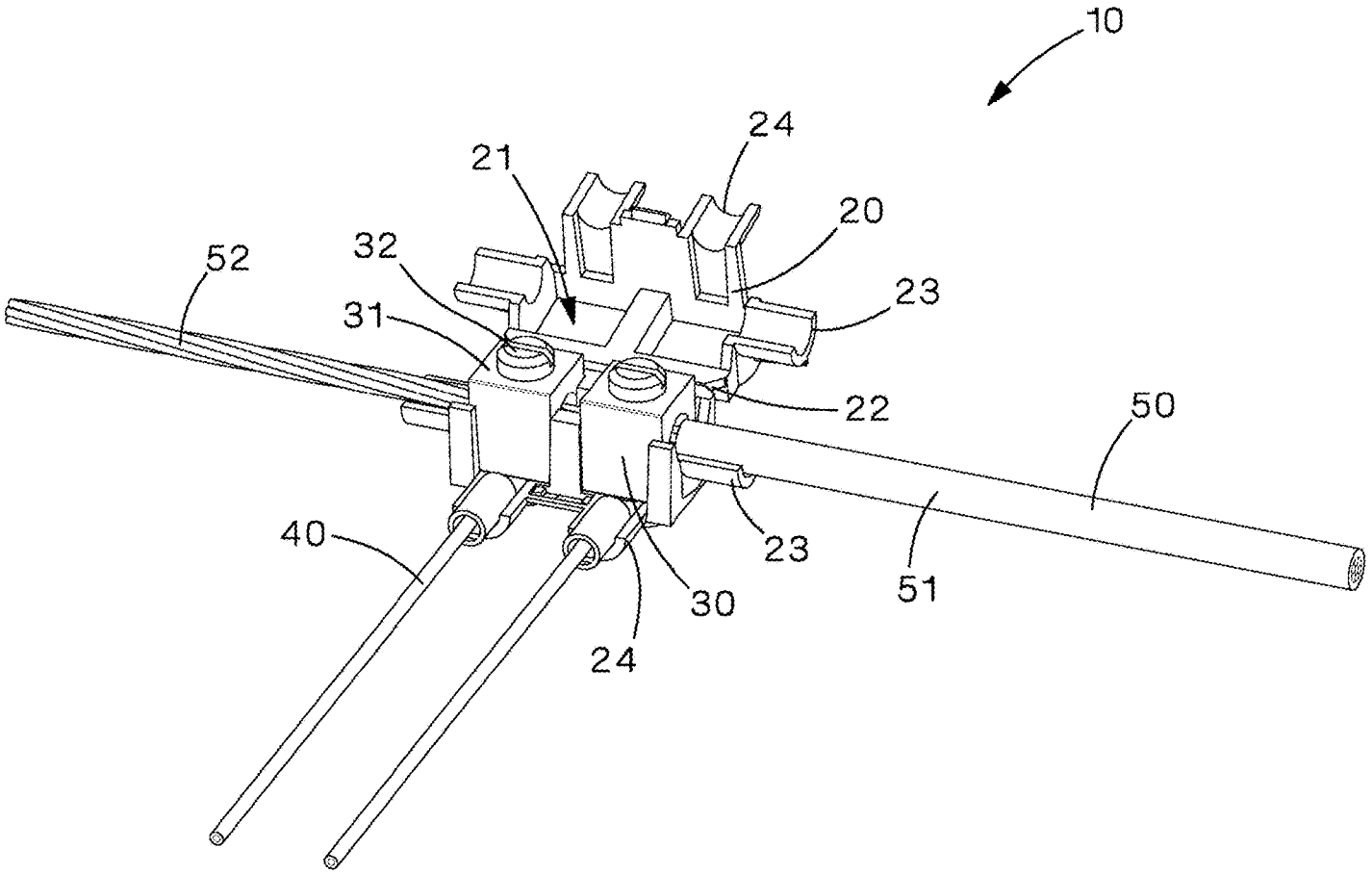
FIG. 1 is an isometric view of a safety termination apparatus connected to a power conductor.
Figure 2:
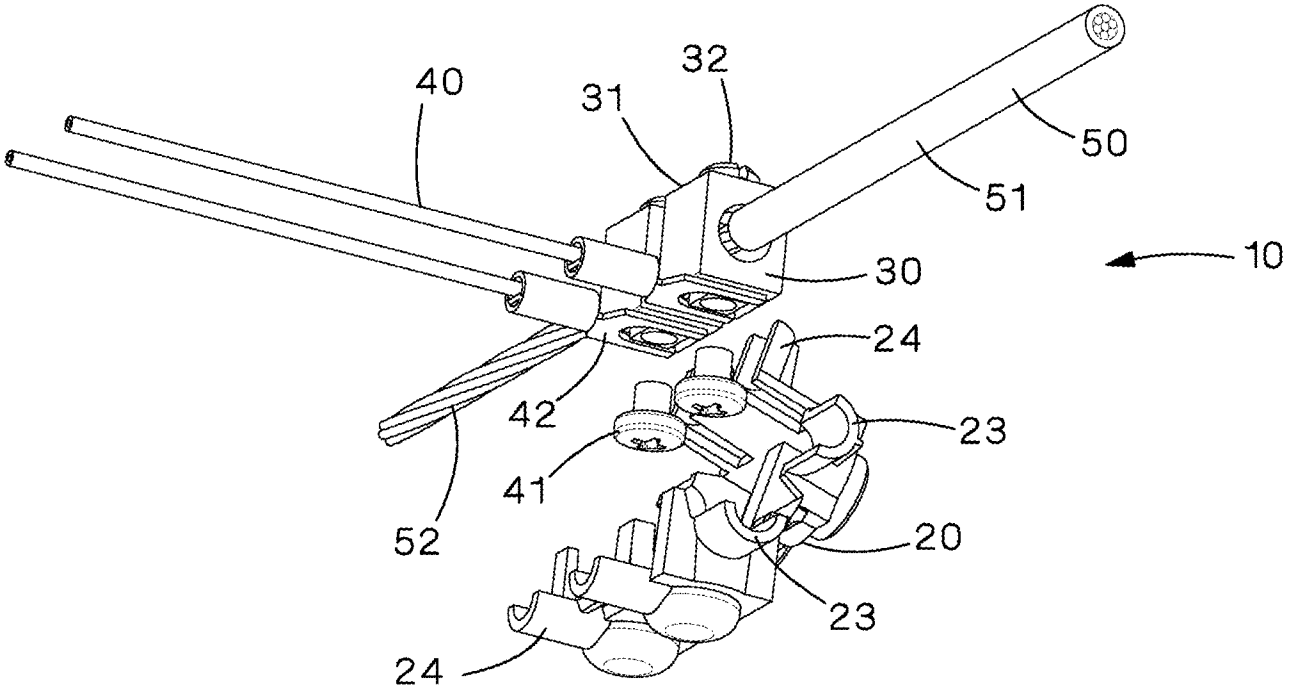
FIG. 2 is an exploded isometric view of the safety termination apparatus and conductor of FIG. 1.
Figure 3:
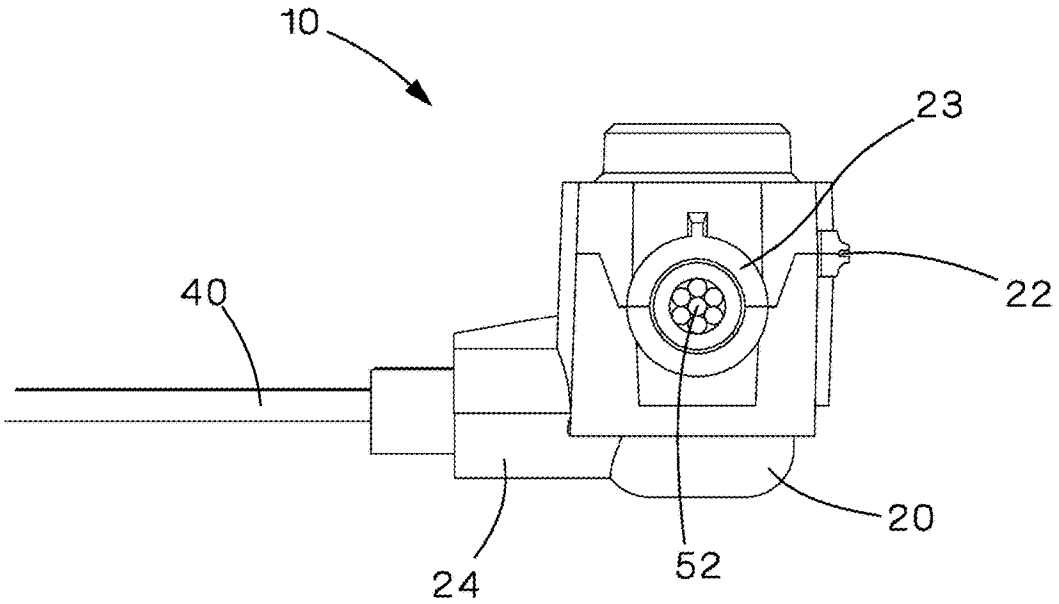
FIG. 3 is a side view of the safety termination apparatus and power conductor of FIG. 1.
Figure 4:
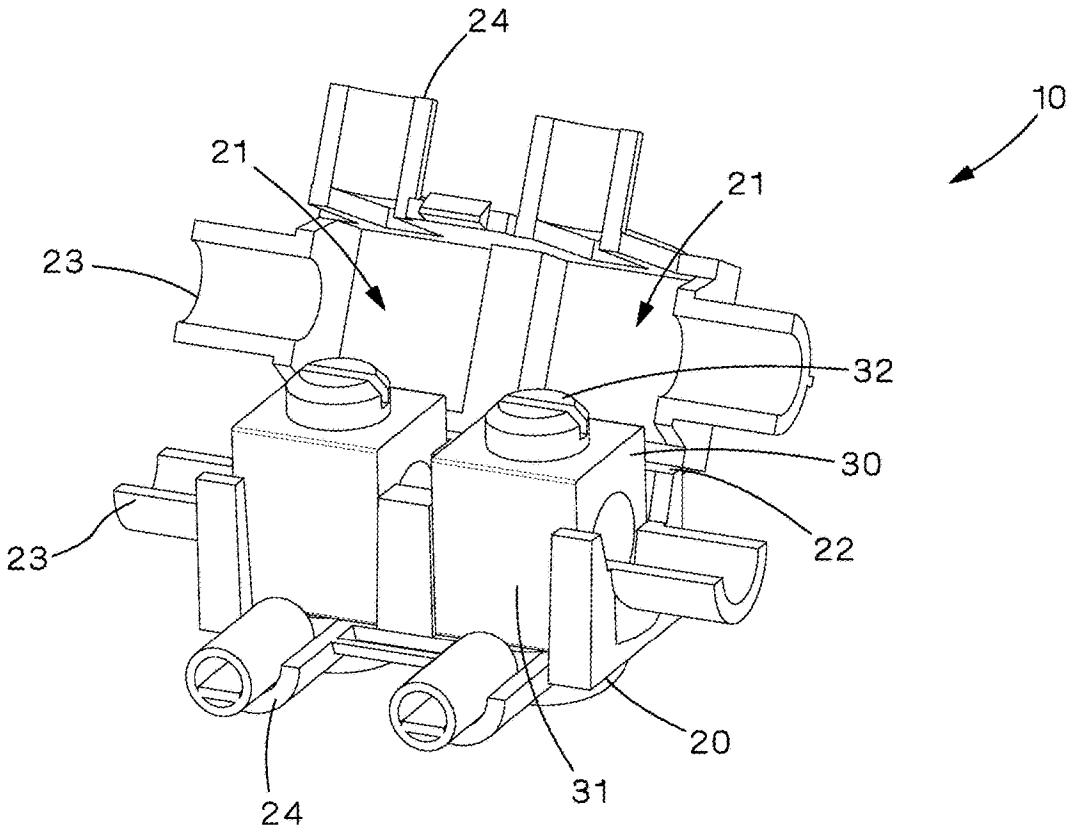
FIG. 4 is an isometric view of the safety termination apparatus of FIG. 1 without the sensor wires and with the insulating housing opened.
Figure 5:
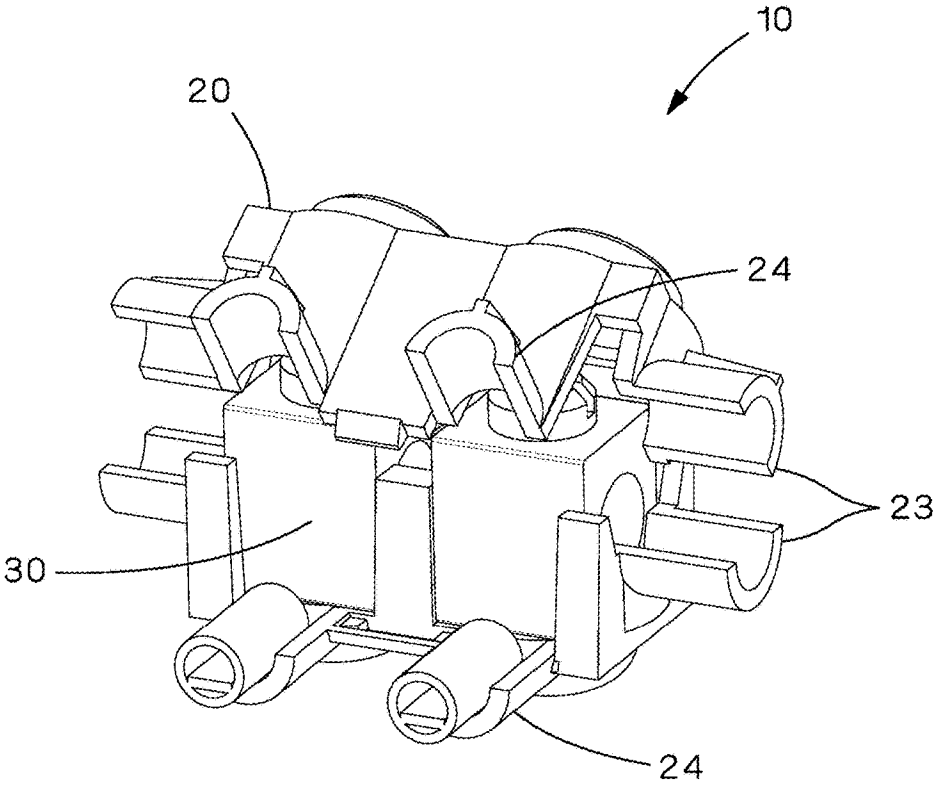
FIG. 5 is an isometric view of the safety termination apparatus of FIG. 4 with the insulating housing partially closed.
Figure 6:
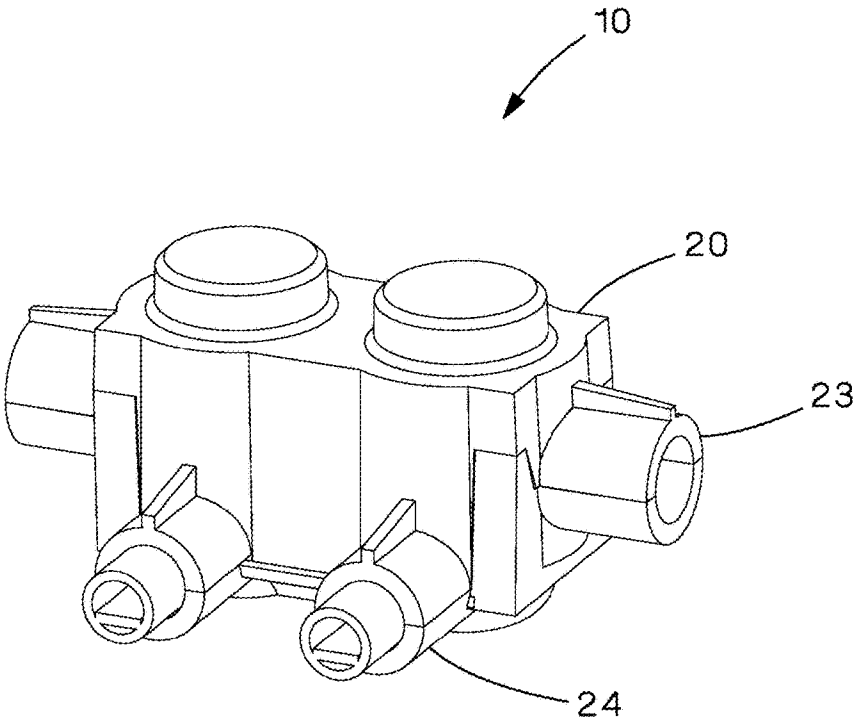
FIG. 6 is an isometric view of the safety termination apparatus of FIG. 4 with the insulting housing completely closed.

FIGS. 1 and 2 show an embodiment of a safety termination apparatus 10 terminated to a power conductor 50 with a portion of the insulation removed. FIGS. 3-6 show additional views of the safety termination apparatus 10. The safety termination apparatus 10 can include an insulating housing 20, galvanic connections 30, and sensor leads 40.

The insulating housing 20 contains first and second compartments 21, one for each of the galvanic connections 30. The separate compartments 21 prevent the galvanic connections 30 from being electrically connected to each other by means other than through a mutual connection to the power conductor 50. The insulating housing has a hinge 22 located on a side with an axis parallel to the power conductor. The insulating housing 20 may have power conductor extensions 23 and sensor wire extensions 24 in order to protect the power conductor 50 and sensor wires 40 as they exit the insulating housing 20. The power conductor extensions 23 are designed to fit snugly around the conductor insulating jacketing 51 on one side and the bare conductor 52 on the other. The power conductor extensions 23 may be tapered on either end to allow the connector to accommodate multiple sizes of power conductors (2-14 AWG and corresponding metric sizes). In one embodiment, the insulating housing 20 is made of an insulating material with high dielectric properties such as ABS or polycarbonate. All conductive surfaces involved in the connection of the safety termination apparatus can be encapsulated by the insulating housing 20 when closed. This provides a "finger safe" (IP20 per IEC 60529) apparatus reducing the risk for shock hazards. It also insulates the connection and prevents contamination or tracking across the joint. The housing may have a living hinge or a tether connecting the two halves which are held together by a molded latch(s) with snap closure features.

The galvanic connection 30 can include a clamp body 31 and a clamp screw 32. The power conductor 50 passes through both clamp bodies 31 and each clamp screw 32 is tightened to make the galvanic connection.

The sensor wires 40 can be attached to the galvanic connection 30 through a variety of methods easily understood by one of ordinary skill in the art. FIGS. 1-6 show a method using a sensor screw 41 and a spade terminal 42.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A safety termination apparatus for connecting to a power conductor comprising:

first and second galvanic connections connected to an uninsulated portion of the power conductor;

a sensor wire electrically connected to each galvanic connection; and an insulating housing enclosing the galvanic connections, the insulating housing having first and second compartments for enclosing the first and second galvanic connections, the first and second compartments separating the first and second galvanic connections such that the first and second galvanic connections are not electrically connected to each other than through a mutual connection to the power conductor.

2. The safety termination apparatus of claim 1 wherein the insulating housing has a hinge along one side with an axis parallel to the power conductor.

3. The safety termination apparatus of claim 1 wherein the insulating housing further comprises power conductor extensions.

4. The termination safety apparatus of claim 3 wherein the power conductor extensions are tapered.

5. The termination apparatus of claim 1 wherein the insulating housing has sensor wire extensions.

6. The termination apparatus of claim 1 wherein the galvanic connections have a clamp body and a clamp screw.

* * * * *